US005637433A

United States Patent [19]

Uchida et al.

[11] Patent Number: 5,637,433

[45] Date of Patent: Jun. 10, 1997

[54] TONER FOR DEVELOPING AN ELECTROSTATIC LATENT IMAGE

[75] Inventors: Tsuyoshi Uchida; Kunio Akimoto, both of Hachioji, Japan

[73] Assignee: Konica Corporation, Japan

[21] Appl. No.: 678,302

[22] Filed: Jul. 11, 1996

[30] Foreign Application Priority Data

Jul. 21, 1995 [JP] Japan ..... 7-185749

[51] Int. Cl.[6] ..... G03G 9/087; G03G 9/097

[52] U.S. Cl. ..... 430/110; 430/111

[58] Field of Search ..... 430/110, 111

[56] References Cited

U.S. PATENT DOCUMENTS

| | | | |
|---|---|---|---|
| 4,957,774 | 9/1990 | Doi et al. | 430/109 |
| 5,110,704 | 5/1992 | Inoue et al. | 430/111 |
| 5,225,308 | 7/1993 | Sasaki et al. | 430/109 |
| 5,384,224 | 1/1995 | Tanikawa et al. | 430/110 |
| 5,478,686 | 12/1995 | Kawakami et al. | 430/106.6 |
| 5,514,510 | 5/1996 | Hayakawa | 430/108 |
| 5,547,800 | 8/1996 | Nishimori et al. | 430/110 |
| 5,578,408 | 11/1996 | Kohtaki et al. | 430/111 |

*Primary Examiner*—Roland Martin

*Attorney, Agent, or Firm*—Jordan B. Bierman; Bierman, Muserlian and Lucas LLP

[57] ABSTRACT

Disclosed is a toner for developing an electrostatic latent image, comprising a binder resin, a colorant and a releasing agent, wherein said toner has:

(1) a storage modulus (G') having a falling starting temperature of 45° to 65° C., when a visco-modulus of said toner is measured by a rheometer, (2) a first inclination represented by $(1/3)\times(\log(\eta'_{121})-\log(\eta'_{118}))$ is −0.065 to −0.035 at 120° C. wherein said log $(\eta'_{121})$ represents a common logarithm of a fusion viscosity (η`) of said toner at 121° C., said log $(\eta'_{118})$ represents a common logarithm of a fusion viscosity (η`) of said toner at 118° C., and said first inclination represented by $(1/3)\times(\log(\eta'_{121})-\log(\eta'_{118}))$ represents an inclination of a tangent at 120° C., when said logarithm of said fusion viscosity (η`) is plotted as a function of degree of Celsius, and (3) a second inclination represented by $(1/3)\times(\log(G'_{200})-\log(G'_{197}))$ is not less than −0.025 at 200° C., wherein said log $(G'_{200})$ represents a common logarithm of said storage modulus (G') at 200° C., said log $(G'_{197})$ represents a common logarithm of said storage modulus (G') at 197° C., and said second inclination represented by $(1/3)\times(\log(G'_{200})-\log(G'_{197}))$ represents an inclination of a tangent at 200° C., when said logarithm of said storage modulus (G') is plotted as a function of degree of Celsius.

12 Claims, 2 Drawing Sheets

TONER FOR DEVELOPING AN ELECTROSTATIC LATENT IMAGE

FIELD OF THE INVENTION

The present invention relates to toner for electrostatic latent image developing used for developing in a copying machine.

BACKGROUND OF THE INVENTION

Heretofore, a dry development system has widely been used for an electrostatic latent image developing method such as in electrophotographic copying machines from viewpoint of safety and reliability.

In addition, as a method for fixing a toner image transferred to a paper medium after being developed by the dry development method, a heat roll fixing system has been widely used from viewpoints of handling ease of the apparatus and high productivity. Recently, in order to realize power consumption conservation and shortening of warming-up time, methods in which a thin endless film layer having a specific heat as the fixing roll, are employed.

Recently, together with advanced development of copying machine technology, copying machines with high productivity and high reliability have been developed. In order to pursue high productivity and high reliability, not only enhancement of mechanical performances of a copying machine but also high performance toner, is essential.

As an approach to realize high productivity, high-speed fixing ability of toner at low temperature have been attempted. As a means for attaining high-speed fixing ability of toner at low temperature, technologies to lower fusion viscosity of a binder resin, i.e., to use a composition having a binder resin whose glass transition temperature is low or to lower the molecular weight of the binder resin, are cited.

However, the above-mentioned means noticeably reduce internal coagulation force of toner when it is in a fusing state, markedly narrowing the fixing temperature allowance. Accordingly, undesirable offset often occurs. In addition, the above-mentioned means also reduces internal coagulation force of toner when it is in a solid state. Therefore, when an automatic double-sided copy mode (ADU mode) is used, contamination of copied images due to contact between the paper feeding roller and paper or rubbing by other sheets, called "smearing" is caused. In addition, when the above-mentioned means are used, movement property of molecule chains of the binder resin is increased when the temperature is high. Accordingly, toners easily coagulate and fuse each other so that they are not suitable for practical use. In the above-mentioned manner, high speed and low temperature fixing of toner is accompanied by various problems. Therefore, in order to obtain toner suitable for practical use, it is necessary to balance the above-mentioned performances and problems.

In the past, there was one approach to control toner's visco-elasticity and thereby to obtain toner having favorable high speed and low temperature fixing performance was made.

For example, Japanese Patent Publication Open to Public Inspection (hereinafter, referred to as Japanese Patent O.P.I. Publication) No. 21557/1986 discloses the use of a developer whose main components are a binder resin and a colorant. The main component of aforesaid binder resin is composed of a vinyl-containing polymer, wherein one $cm^3$ of aforesaid binder resin is extruded from a nozzle whose diameter is 1 mm and the length is 1 mm under the constant temperature climbing rate of 6° C./min. and a load of 20 $kg/cm^2$ by the use of a high bridge-type flow tester so that the degree of flowing out is measured and that, when the natural logarithm of the apparent viscosity calculated from aforesaid value is plotted against temperature, the absolute value of the inclination of the graph is 0.15 Ln (the apparent viscosity in terms of poise)/° C. or less.

Japanese Patent O.P.I. Publication No. 101961/1988 discloses a toner component, containing a vinyl polymer, wherein the number average molecular weight is 1,000–10,000, the weight average molecular weight/the number average molecular weight is 41–200, its glass transition temperature is 50°–70° C., viscosity at 110° C. is 5,000–5,000,000 poise in terms of shear rate of 1 $sec^{-1}$ and viscosity is 10–1,000 poise at 190° C. in terms of shear rate of 1 $sec^{-1}$ as the major component.

Japanese Patent O.P.I. Publication No. 133065/1989 discloses a toner, containing a binder resin and a colorant, containing fusion viscosity is $5\times10^5$–$10^6$ poise at 110° C. and that is $9\times10^4$–$3\times10^5$ poise at 120° C.

Japanese Patent O.P.I. Publication No. 122659/1991 discloses a toner for heating and fixing whose major binder resin is a resin wherein the flowing starting temperature (Tfb) by means of a high-bridged-type flow tester is 75°–105° C., the absolute value of the inclination of a graph at Tfb +20 when the common logarithm logη' of fusion viscosity (η) is plotted on the temperature is 12 log (fusion viscosity in terms of poise)/° C. or more, the absolute value of the inclination of a graph at Tfb+40° C. is 4.4 log (fusion viscosity in terms of poise) and the constant logarithm of the fusion viscosity at Tfb+40° C. is 4.4 log (fusion viscosity in terms of poise).

Japanese Patent O.P.I. Publication No. 303447/2989 discloses a toner for electrostatic latent developing, containing a styrene resin, as a major component, wherein the molecular weight distribution is at least in the range of $1\times10^4$ or less and $5\times10^5$ or more, the storage modulus is $1\times10^3$ $dyn/cm^2$ or more and the loss modulus is not more than $5\times10^3$ $dyn/cm^2$.

Japanese Patent O.P.I. Publication No. 67154/1992 discloses a toner, composed of a binder resin and a colorant, wherein the weight average molecular weight of the binder resin is 50,000–5,000,000 and when toner is 100°–150° C. the temperature difference necessary to change toner viscosity due to heating from $5\times10^6$–$5\times10^4$ poise is 32° C. or more.

Japanese Patent O.P.I. Publication No- 338972/1992 discloses a toner whose major component is a binder resin and a colorant wherein the binder resin is composed of (a) 70–80 parts by weight of a styrene copolymer A wherein GPC molecular weight peak Lp is $5\times10^3$–$1.5\times10^4$ and (b) 30–20 parts by weight of a styrene copolymer B wherein GPC peak Hp is $4\times10^5$–$2\times10^6$, styrene monomer content Wl (weight %) in $L_p$ and styrene monomer content Wh in $H_p$ are respectively 50 weight % or more and concurrently with this Wl and Wh form a mixed resin wherein Wl<Wh, when aforesaid resin has the storage modulus of $5\times10^3$ to $5\times10^4$ $^l$at 170° C. provided that the angular frequency ω of 10 rad/sec the dynamic loss tangent (tan 8) is 1.2 to 3.5 and the dynamic viscosity ratio is in the range of $500\leqq\eta'\leqq500$ (poise).

Japanese Patent O.P.I. Publication No. 353866/1992 discloses a toner for electrophotography having a rheological property of, under measurement distortion of 1 deg. when the measurement frequency is 1 Hz, (1) the falling starting temperature of the storage modulus is in the range of 100°–110° C., (2) the above-mentioned storage modulus at 150° C. is $1\times10^4$ or less and (3) the peak temperature of the loss modulus is 125° C. or more.

Due to control of the visco-modulus as described above, toner performance is improved to some extent. However, it is a current circumstance that a toner excellent in high speed and low temperature fixing performance, anti-hot offset performance, anti-smearing performance, and anti-coagulation performance has not been obtained.

SUMMARY OF THE INVENTION

Considering the above-mentioned circumstances, an objective of the present invention is to provide a toner for developing electrostatic latent image excellent in high speed and low temperature fixing performance, anti-hot offset performance, anti-smearing performance, and anti-coagulation performance.

Another objective of the present invention is to provide a heat contact fixing method of high reliability and excellent in speed and, excellent fixing performance at a low temperature and also excellent in anti-offset performance. The above objects are attained by the following items.

Item 1 A toner for developing an electrostatic latent image, comprising a binder resin, a colorant and a releasing agent, wherein said toner has:

(1) a storage modulus (G') having a falling starting temperature of 45° to 65° C., when a visco-modulus of said toner is measured by a rheometer, (2) a first inclination represented by $(1/3)\times(\log(\eta'_{121})-\log(\eta'_{118}))$ is −0.065 to −0.035 at 120° C., wherein said $\log(\eta'_{121})$ represents a common logarithm of a fusion viscosity (η) of said toner at 121° C., said $\log(\eta'_{118})$ represents a common logarithm of a fusion viscosity (η) of said toner at 118° C., and said first inclination represented by $(1/3)\times(\log(\eta'_{121})-\log(\eta'_{118}))$ represents an inclination of a tangent at 120° C., when said logarithm of said fusion viscosity (η) is plotted as a function of degree of Celsius, and (3) a second inclination represented by $(1/3)\times(\log(G'_{200})-\log(G'_{197}))$ is not less than −0.025 at 200° C., wherein said $\log(G'_{200})$ represents a common logarithm of said storage modulus (G') at 200° C., said $\log(G'_{197})$ represents a common logarithm of said storage modulus (G') at 197° C., and said second inclination represented by $(1/3)\times(\log(G'_{200})-\log(G'_{197}))$ represents an inclination of a tangent at 200° C., when said logarithm of said storage modulus (G') is plotted as a function of degree of Celsius.

Item 2 The toner of item 1, wherein said binder resin comprises a resin selected from the group consisting of polyester resins and vinyl resins.

Item 3 The toner of item 1, wherein said binder resin comprises a vinyl resin having a monomer unit selected from the group consisting of an aromatic vinyl monomer unit and an α-methylene aliphatic carboxylic ester monomer unit.

Item 4 The toner of item 1, wherein said binder resin comprises a vinyl resin having a low-molecular weight component and a high-molecular weight component, wherein said low-molecular weight component has a maximum value of not more than 30,000 in a molecular weight distribution measured by gel permeation chromatography, and said high-molecular weight component has a maximum value of not more than 70,000 in a molecular weight distribution measured by gel permeation chromatography.

Item 5 The toner of item 1, wherein said binder resin is a vinyl resin having a low-molecular weight component and a high-molecular weight component, wherein said low-molecular weight component has a weight average molecular weight ($Mw_L$) of 2,000 to 15,000 measured by gel permeation chromatography, and said high-molecular weight component has a weight average molecular weight ($Mw_H$) of $3\times10^5$ to $5\times10^6$ measured by gel permeation chromatography.

Item 6 The toner of item 5, wherein said vinyl resin has a glass transition point (Tg) of 45° to 65° C., said low-molecular weight component is contained in an amount ($W_L$) of 60 to 90% by weight of said resin, and said glass transition point(Tg), said amount ($W_L$), said weight average molecular weight ($Mw_L$) satisfy the following equations 1, 2 and 3:

$$300\times W_L-2000\times Tg+80{,}000<Mw_L<300\times W_L-2000\times Tg+111{,}000, \quad \text{Equation 1}$$

$$\text{Log}(Mw_H)-0.08\times W_L+0.4>0, \quad \text{Equation 2}$$

$$800\times W_L-64{,}000<Mw_L<800\times W_L-38{,}000. \quad \text{Equation 3}$$

Item 7 The toner of item 1, wherein said binder resin is a vinyl resin having a low-molecular weight component and a high-molecular weight component, wherein a first glass transition point ($Tg_L$) of said low-molecular-weight component and a second glass transition point ($Tg_H$) of said high-molecular-weight component satisfy the following equation 4:

$$|Tg_L-Tg_H|\leqq 20\ (°\ C.). \quad \text{Equation 4}$$

Item 8 The toner of item 1, wherein said binder resin comprises a vinyl resin having a low-molecular weight component and a high-molecular weight component, wherein said low-molecular weight component and said high-molecular weight component contain a monomer unit selected from the group consisting of an aromatic vinyl monomer unit and an α-methylene aliphatic carboxylic ester monomer unit.

Item 9 The toner of item 8, wherein a first aromatic vinyl monomer content ratio ($St_L$) of said low-molecular weight component and a second aromatic vinyl monomer content ratio ($St_H$) of said high-molecular weight component satisfy the following equation 2:

$$0.5<St_L/St_H\leqq 2.0. \quad \text{Equation 2}$$

Item 10 The toner of item 3, wherein an aromatic vinyl monomer of said aromatic vinyl monomer unit is a monomer selected from the group consisting of styrene, o-methylstyrene, m-methylstyrene, p-methylstyrene, p-ethylstyrene, 2,3-dimethylstyrene, 2,4-dimethylstyrene, p-n-butylstyrene, p-terbutylstyrene, p-n-hexylstyrene, p-n-octylstyrene, p-nnonylstyrene, p-n-decylstyrene, p-n-dodecylstyrene, p-methoxystyrene, p-chlorostyrene and 3,4-dichlorostyrene.

Item 11 The toner of item 3, wherein a α-methylene aliphatic carboxylic ester monomer of said α-methylene aliphatic carboxylic ester monomer unit is a monomer selected from the group consisting of methyl acrylate, ethyl acrylate, propyl acrylate, n-butyl acrylate, isobutyl acrylate, n-octyl acrylate, dodecyl acrylate, 2-ethylhexyl acrylate, stearyl acrylate, methyl methacrylate, ethyl methacrylate, propyl methacrylate, n-butyl methacrylate, isobutyl methacrylate, n-octyl methacrylate, dodecyl methacrylate, 2-ethylhexyl methacrylate and stearyl methacrylate.

Item 12 A toner for developing an electrostatic latent image, comprising a binder resin, a colorant and a releasing agent, wherein said toner has:

(1) a storage modulus (G') having a falling starting temperature of 45° to 65° C., when a visco-modulus of said toner is measured by a rheometer, (2) a first inclination represented by $(1/3)\times(\log(\eta'_{121})-\log(\eta'_{118}))$ is −0.065 to −0.035 at 120° C., wherein said $\log(\eta'_{121})$ represents a common logarithm of a fusion viscosity (η) of said toner at 121° C., said $\log(\eta'_{118})$ represents a common logarithm of a fusion viscosity (η) of said toner at 118° C., and said first inclination represented by $(1/3)\times(\log(\eta'_{121})-\log(\eta'_{118}))$ represents an inclination of a tangent at 120° C., when said logarithm of said fusion viscosity (η) is plotted as a function of degree of Celsius, and (3) a second inclination represented by $(1/3)\times(\log(G'_{200})-\log(G'_{197}))$ is not less than −0.025 at 200° C., wherein said $\log(G'_{200})$ represents a common logarithm of said storage modulus (G') at 200° C., said $\log(G'_{197})$ represents a common logarithm of said storage modulus (G') at 197° C., and said second inclination represented by $(1/3)\times(\log(G'_{200})-\log(G'_{197}))$ represents an inclination of a tangent at 200° C., when said logarithm of said storage modulus (G') is plotted as a function of degree of Celsius, and, wherein said binder resin comprises a vinyl resin, wherein said vinyl resin has:

a monomer unit selected from the group consisting of an aromatic vinyl monomer unit and an α-methylene aliphatic carboxylic ester monomer unit, and a low-molecular weight component and a high-molecular weight component, wherein said low-molecular weight component has a maximum value of not more than 30,000 in a molecular weight distribution measured by gel permeation chromatography, and said high-molecular weight component has a maximum value of not more than 70,000 in a molecular weight distribution measured by gel permeation chromatography.

DETAILED DESCRIPTION OF THE INVENTION

Figure 1:
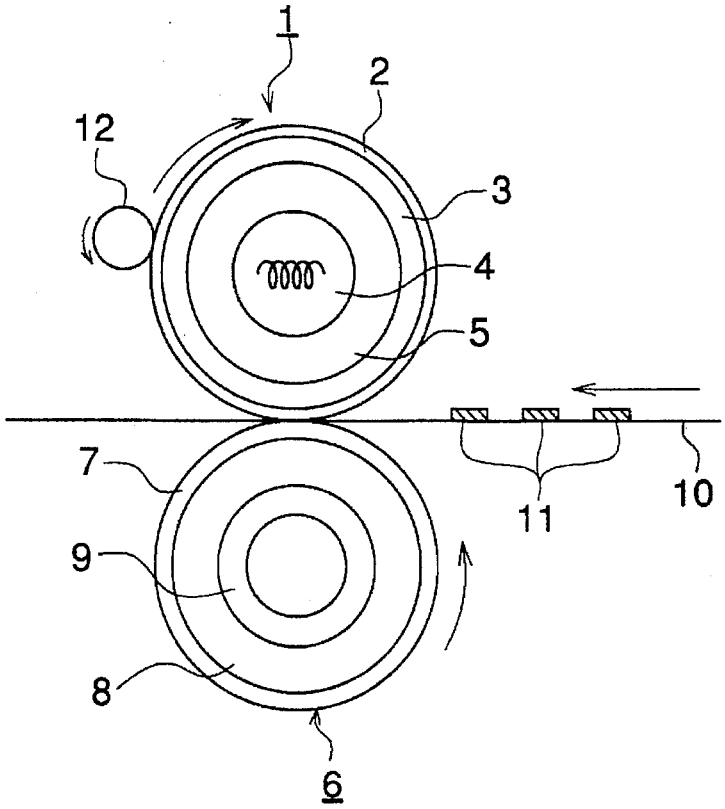
FIG. 1 is a drawing showing a schematic diagram example of a heat roller fixing method of one example of the present invention.

After laborious study, the present inventors discovered that toner for electrophotography excellent in all of low temperature fixing performance, anti-offset performance, anti-smearing performance, and anti-coagulation performance can be obtained by controlling the visco-modulus of toner within a specified range for thereby attaining the present invention.

[1] A toner for electrostatic latent developing containing at least a binder resin, a colorant and a releasing agent, wherein 1) there is falling starting temperature of the storage elasticity (G') between temperature range of 45°–65° C., 2) the inclination $(1/3)\times(\log(\eta'_{121})-\log(\eta'_{118}))$ of the contact of a viscosity curve when the common logarithm of the viscosity is plotted against the temperature is −0.065 to −0.035 at 120° C. and 3) the inclination $(1/3)\times(\log(G'_{200})-\log(G'_{197}))$ of the contact of a storage elasticity curve when the common logarithm of the storage elasticity is plotted against the temperature is −0.025 or more at 120° C.

[2] A toner image fixing method wherein a recording medium which carries a visual image employing toner for electrostatic latent developing having the following characteristics 1, 2 and 3 each containing at least a binder resin, a colorant and a releasing agent is conveyed while aforesaid recording medium is brought into pressure contact with a heating source for heat-fixing.

1) falling starting temperature of the storage modulus (G') is present between temperature range of 45°–65° C., 2) the inclination $(1/3)\times(\log(\eta'_{121})-\log(\eta'_{118}))$ of the tangent of a viscosity curve when the common logarithm of the viscosity is plotted on the temperature is −0.065 to −0.035 at 120° C. and 3) the inclination $(1/3)\times(\log(G'_{200})-\log(G'_{197}))$ of the tangent of a storage elasticity curve when the common logarithm of the storage modulus is plotted againt the temperature is not less than −0.025 at 120° C.

In the present invention, the visco-modulus of toner is measured under the following conditions.

When the toner visco-modulus was measured, 0.5 g of toner was made to a pellet having diameter of 1 cm by the use of a compression molding machine. This pellet was loaded onto a parallel plate having a diameter of 1 cm wherein the gap was set to 6 mm. The temperature of the measurement unit was set to 120° C., and the parallel plate gap was 3 mm. After the measurement unit temperature was set to −20° C. using liquid nitrogen, while applying sine wave vibration of frequency of 10 Hz was applied, the temperature of the measurement unit was increased to 200° C. at 5° C./min so that dynamic visco-modulus in an arbitrary temperatures was measured. The distortion angle was changed in a range of 0.05–5 deg. Incidentally, for the measuring instrument, MR-500 produced by Rheology Inc. was used.

Dynamic visco-modulus is measured by applying a sample vibration at a constant frequency. The ratio of stress applied to a sample and the distortion rate of the sample is ordinarily referred to as modulus or complex modulus. And the real number parts of complex modulus represents a storage modulus.

On the contrary, the ratio of stress applied to a sample and the strain rate of the sample is referred to as of viscosity or complex of viscosity.

Measuring instrument: MR-500 produced by Rheology Inc.

Frequency: 10 Hz

Plate diameter: 1.0 cm (parallel plate)

Gap: 3.0 mm

Distortion angle: 0.05–5 (deg)

Measurable temperature range: −20° C.–200° C.

With regard to toner for producing electrostatic latent images of the present invention (hereinafter, referred to as "toner of the present invention"), it is preferable to have falling starting temperature of the storage modulus (G') between temperature range of 45° to 65° C. when its visco-modulus is measured by means of a rheometer. When the falling starting temperature of G' is 45° to 65° C., anti-smearing performance is not improved, and further, since the toner G' is lowered during fixing, coagulation force is low, therefore the high speed and low temperature performance are improved.

When the visco-modulus of the toner of the present invention is measured by a rheometer, it is preferable that the inclination $(1/3)\times(\log\eta'_{121}-\log\eta'_{118})$ of the tangent of the viscosity curve when the common logarithm of the storage modulus is plotted against the temperature is −0.065 to −0.035 at 120° C. If $(1/3)\times(\log\eta'_{121}-\log\eta'_{118})$ is −0.065 to −0.035 at 120° C., the reduction of the viscosity of the toner can be appropriately controlled and the internal coagulation force of the toner component does not remarkably reduce at high temperature so that anti-offset performance is improved. Further, high speed and low temperature fixing performance are improved.

When the visco-modulus of the toner of the present invention is measured by a rheometer, it is preferable that the inclination $(1/3)'(\log G'_{200}-\log G'_{197})$ of the tangent of the storage modulus curve when the common logarithm of the storage modulus is plotted against temperature is not less than −0.025 at 200° C. When $(1/3)\times(\log G'_{200}-\log G'_{197})$ is not less than −0.025 at 200° C., the storage modulus of the toner component is not reduced under high temperature, therefore, the internal coagulation force of the toner component is not reduced. Accordingly, the anti-offset performance is improved.

As a binder resin of the toner of the present invention, polyester resins, vinyl resins and mixed resins of the above-mentioned resins can be used. Of these, it is specifically preferable to use vinyl resins.

As a vinyl resin, copolymers obtained from an aromatic vinyl monomer and/or an R-methylene aliphatic carboxylic ester are preferably used. In addition, copolymers obtained from a styrene-containing monomer and/or acrylic acid ester or ester methacrylate may also be used. As a component having a carboxylic group at a side chain, copolymers containing an acrylic acid or a methacrylic acid-containing monomer can also be used.

As a styrene monomer in an aromatic vinyl monomer, for example, styrene, o-methylstyrene, m-methylstyrene, p-methylstyrene, p-ethylstyrene, 2,3-dimethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chrorostyrene and 3,4-dichlorostyrene are cited. Of these, styrene is preferable.

As an acrylic acid or a methacrylic acid monomer in an α-methylene aliphatic monocarboxylic acid ester monomer, for example, alkylester of acrylic acid or methacrylic acid such as acrylic acid methyl, ethyl acrylate, propyl acrylate, acrylic acid-n-butyl, isobutyl acrylate, acrylic acid-n-octyl, dodecyl acrylate, acrylic acid-2-ethylhexyl, stearyl acrylate, methyl methacrylate, ethyl methacrylate, propyl methacrylate, methacrylic acid-n-butyl, isobutyl methacrylate, methacrylic acid-n-octyl, dodecyl methacrylate, methacrylic acid-2-ethylhexyl and stearyl methacrylate are cited.

As an acrylic acid or a methacrylic acid monomer, an acrylic acid and a methacrylic acid are preferable.

In addition, for polymerizing the above-mentioned aromatic vinyl monomer and/or an α-methylene aliphatic monocarboxylic acid ester component, a solution polymerization method, a suspension polymerization method, an emulsification polymerization method and a bulk polymerization method are used suitably. Of these, the solution polymerization method and the suspension polymerization method are used most suitably.

In the present invention, it is preferable that vinyl resins contain a low-molecular-weight component and a high-molecular-weight component. Among toners which use the above-mentioned vinyl resins, those having the above-mentioned dynamic visco-modulus can satisfy the high speed and low temperature performance, storage performance, anti-hot offset performance and anti-smearing performance. In addition, the above-mentioned toner may contain components other than the above-mentioned low-molecular-weight component and the high-molecular-weight component.

It is preferable that a weight average molecular weight ($Mw_L$) of the low-molecular-weight component measured by Gel Permeation Chromatography (hereinafter, referred to as GPC) is 2,000–15,000. When $Mw_L$ is 2,000 to 15,000, the falling starting temperature of storage elasticity is not lowered, storage performance and anti-smearing performance are improved. In addition, the viscosity at the fixing temperature is low so that sufficient high speed and low temperature fixing performance can be obtained.

It is preferable that a weight average molecular weight ($Mw_H$) of the high-molecular-weight component measured by GPC is $3\times10^5$ to $5\times10^6$. When $Mw_H$ $3\times10^5$ to $5\times10^6$, internal coagulation force is not reduced when toner is fused, resulting in sufficient hot offset performance. In addition, the lowering of toner viscosity is not hindered so that sufficient high speed and low temperature fixing performance can be obtained.

In the present invention, the low-molecular-weight component is defined to be a maximum value of not more than 30,000 in its molecular weight distribution measured by GPC and the high-molecular-weight is defined to be a maximum value of not less than 70,000 in its molecular weight distribution measured by GPC.

It is preferable that the following equation is satisfied between the glass transition temperature ($Tg_L$) of the low-molecular-weight component and the glass transition temperature ($Tg_H$) of the high-molecular-weight component.

$$|Tg_L-Tg_H|\leqq 20\ (°\ C.)$$

When $|Tg_L-Tg_H|\leqq 20$ (° C.) high-molecular-weight component and low-molecular-weight component are not separated each other and a portion composed only of low-molecular-weight component does not exist. Accordingly, a part having extremely small internal cohesion forces does not exist in the toner component so that the anti-smearing performance is improved.

The glass transition point was measured by a differential scanning calorimeter DSC-7 produced by Perkin Elmer Inc. Namely, 5 mg of toner was sampled into an aluminum pan and then sealed. Next, the measurement sample pan was heated from 0° C. to 100° C. at 10° C./min. Following this, at 100° C. for 3 minutes, the measurement sample pan was cooled to 0° C. at 10° C./min. After keeping 0° C. for 3 minutes, it was increased to 100° C. at 10° C./min. The glass transition temperature was defined as the offset temperature of the endothermic peak at the second heating.

In addition, it is preferable that the low-molecular-weight component and the high-molecular-weight component are respectively the above-mentioned aromatic vinyl monomer component and a copolymer obtained from α-methylene aliphatic monocarboxylic acid ester monomer component.

It is preferable that the following equation is satisfied between the aromatic vinyl monomer (St) content ratio ($St_L$: proportion by weight) in the low-molecular-weight component and St component content ratio ($St_H$; proportion by weight) in the high-molecular-weight component.

$$0.5\leqq St_L/St_H\leqq 2.0$$

In case where $0.5\leqq St_L/St_H\leqq 2.0\leqq St_L/St_H$, since the high-molecular-weight component and low-molecular-weight component are not separated each other, a portion composed only of low-molecular-weight component does not exist and parts having extremely small internal cohesion does not exist in the toner component, an anti-smearing performance is not deteriorated.

It is preferable that the content ratio ($W_L$: weight %) of the low-molecular-weight component in the above-mentioned binder resin is 60–90%. In case where $W_L$ is 60 to 90%, the viscosity of toner is not increased, high speed and low temperature performance can be obtained. Further, anti-smearing performance of toner is improved.

It is preferable that the glass transition temperature ($Tg_T$) of the toner component of the present invention is 45°–65° C. In case where $Tg_T$ is 45° to 65° C., the storage performance of the toner component is improved and the viscosity of the toner is not increased, high speed and low temperature fixing performance can be obtained.

In the present invention, the glass transition point of each of the above-mentioned resins is the same as that of each toner prepared by using the resin mentioned above.

The above-mentioned binder resins can be obtained by blending a low-molecular-weight component and a high-molecular-weight component in a solution, by polymerizing a low-molecular-weight component monomer in a reactive solution containing a high-molecular-weight component or by polymerizing a low-molecular-weight component and then adding a high-molecular-weight component to the reactive solution for mixing.

As a releasing agent incorporated in the toner of the present invention, low-molecular-weight polyolefine such as polypropylene and polyethylene and their derivatives, alkylenebis fatty acid amide compounds, paraffin wax or amixtures of two or more kind thereof are preferably used. The content weight of the above-mentioned waxes is ordinarily 1 to 20 parts by weight and preferably 2 to 15 parts by weight per 100 parts by weight of binder resin.

The toner of the present invention incorporates with a colorant. For such colorants, for example, carbon black, nigrosine dyes, aniline blue, charcoal blue, chrome yellow, ultramarine blue, Du Pont oil red, quinoline yellow, methyleneblue chloride, phthalocyanine blue, Malachite Green oxalate and Lamp black Rose Bengal are cited. In addition, if the toner of the present invention is magnetic toner, the following magnetic materials can be used as a colorant.

For a magnetic material used for toner of the present invention, iron oxide such as magnetite, hematite and ferrite, metals such as iron, nickel and cobalt and alloys with the above-mentioned metals and metals such as aluminum, cobalt, copper, lead, magnesium, tin, zinc, antimony, beryllium, bismas, cadmium, calcium, manganese, selenium, titanium, tungsten and vanadium are cited.

The volume average particle size of the above-mentioned magnetic material is preferably 0.1–2 μm, and more preferably 0.1–0.5 μm. The amount incorporated in the toner may be 40–150 weight % against 100 parts by weight of resin component.

The toner of the present invention is produced in the following manner.

Binder resins, colorants, releasing agents and magnetic powder used as necessary were subjected to dry blending. Following this, the resulting mixture was subjected to molten kneading by an extruder, a kneader, a kneading roller or a tightly-closed type mixer in such a manner that all components in the toner become uniform. After chilling it, the toner is minutely crushed with a jet mill or a turbo mill, and then, classified. Next, by dry-blending external additives such as a classification-completed toner wherein the particle size is a prescribed one and silica and a cleaning assisting agent as necessary, the toner is obtained.

As a suitable heat fixing method used in the present invention, a heat roll fixing method (FIG. 1) and a fixing method (FIGS. 2 and 3) which heat and fix toner images on a recording medium due to a heating material fixed and mounted and a pressure member which faces aforesaid heating material and presses and rotates a recording medium for applying aforesaid recording medium to aforesaid heating material through a film member.

Hereunder, a heat fixing method applied favorably to the present invention will be explained.

When the heat roller fixing method of the present invention will now be explained referring to FIG. 1, it is formed by upper roller 1 having heating source 4 inside metallic cylinder 5, which is constituted of iron or aluminum having silicone rubber whose surface 2 is covered with a fluorine-containing resin such as polytetrafluoroethylene or a polytetrafluoroethylene-perfluoroalkoxy vinyl ether copolymer, and lower roller 6 made of silicone rubber which is covered with a fluorine-containing resin such as polytetrafluoroethylene (Teflon, its registered name) or a polytetrafluoroethylene-perfluoroalkoxy vinyl ether copolymer as the surface layer 7. Specifically, upper roller 1 has a bar-shaped heater as heating source 4 so that the surface of upper roller 1 is heated to about 110° to 220° C. Between this upper roller 1 and lower roller 6, recording material 10 which carries toner image 11 of the present invention is passed through so that toner image 11 is heat-fused and then fixed on recording material. According to conventional heat roller fixing methods, a portion of fused toner is disposed on upper roller 1 so that, after one rotation, offset phenomenon wherein the toner disposed on the above-mentioned upper roller 1 is stuck to another portion occurs. In addition, in extreme cases, a so-called rolling phenomenon wherein the toner fused onto the upper roller 1 is not separated from the recording material and rolls onto upper roller 1 together with the recording material, and in addition, the surface of the fixing roller becomes contaminated. At the fixing unit, pressure is applied between upper roller 1 and lower roller 6 so that upper and lower rollers are deformed. Accordingly, a so-called "nip" is formed. The nip width is ordinarily 1 to 10 mm, and preferably 3 to 7 mm. Fixing line speed is preferably 40 to 400 mm/sec. When the nip width is too narrow, heat cannot be provided to toner uniformly, resulting in the occurrence of uneven fixing. On the contrary, when the nip width is too great, fusion of toner is promoted so that fixing off-set easily occurs.

When pressing force is less than 4N/cm, the deformation of toner is difficult to be accelerated. Therefore, fixing of the toner onto a recording medium is difficult to be conducted sufficiently. On the other hand, when the pressing force exceeds 10 N/cm, wrinkle or curling (reversing) is caused on a thick paper or an envelope wherein several sheets of paper are sealed when fixing.

The hardness difference between the upper roller and the lower roller is preferably 5° or less. When the hardness difference exceeds 5°, wrinkling or curling is easily caused on thick paper or envelopes. Therefore, pressing force between each fixing roller is restricted to less than 4 N/cm. As a result, deformation of toner is not promoted and it is difficult to fix toner sufficiently on a recording medium such as thick paper or envelope wherein several sheets of paper are sealed. Incidentally, the hardness of the upper roller and the lower roller was measured using an ASKER-C hardness tester which is standardized as SRIS (Japan rubber Institute Standard)-0101.

The latter fixing method will now be explained referring to FIG. 2. Numeral 25, a bar-shaped heating material with low heat capacity, which is fixed and supported on an apparatus, is alumna base board 27, on which a resistance material was coated at thickness of 1.0 to 2.5 mm, whose thickness is 0.2 to 5.0 mm and preferably 0.5 to 3.5 mm, the width is 10 to 15 mm and the length in the longitudinal direction is 240 to 400 mm. It is turned on electricity from both ends. An electric current of DC 100 V is flowed into the line-shaped heating materials 15 in the form of a pulse of 25 msec. in frequency in such a manner that the pulse width is modulated in accordance with the required amount of energy on the basis of the temperature measured by temperature sensor 26. Provided that temperature, sensed at line-shaped heating material 15 with low heat capacity, by means of temperature sensor 16, is T1, surface temperature T2 of film member 24 which faces the resistance material is lower than T1. Here, T1 is preferably 110° to 220° C. Temperature of T2 is preferably lower than that of T1 by 0.5° to 10° C. Surface temperature T3 of band-shaped film member at a point where band-shaped film member 24 is peeled from the surface of the fixed toner is almost equivalent to T2. In the above-mentioned manner, band-shaped film member, after being brought into contact with the heated material, whose energy and temperature are controlled, moves toward the same direction as the recording member. The above-mentioned band-shaped film member 14 is a heat-resisting film, whose thickness is 10 to 35 μm, made of a polyester, polyperftuoroalkylvinyl ether, polyimide and polyether imide, covered with a releasing agent layer, whose thickness is 5 to 15 μm, wherein a conductive member is added to a fluorine resin such as Teflon, and is preferably formed of an endless film. Ordinarily, band-shaped film member 24, whose total thickness is 10 to 100 μm, is conveyed due to the driving and tension by means of driving roller 21 for the band-shaped film member and driven roller 22 for the film member without wrinkling or crumpling. Pressure roller 23 has an elastic rubber layer having high releasing property such as silicone rubber. It provides a total pressure of 20 to 300N with low heat volume to line-shaped heating material 25 through film member 24. The above-mentioned pressure member rotates in the arrowed direction while pressing on the line heated material. By passing the recording material, which carries the toner image, between the above-mentioned film member 24 and pressure roller 23, the recording material is caused to pass through line-shaped heating material 25 at low heat volume, and thereby the toner image is caused to be heat-fixed onto the recording material.

Another example of the latter fixing method will be explained, referring to FIG. 3. While the above-mentioned example of FIG. 2 uses an endless band-shaped film member, FIG. 3 uses an double-ending film member.

Figure 2:
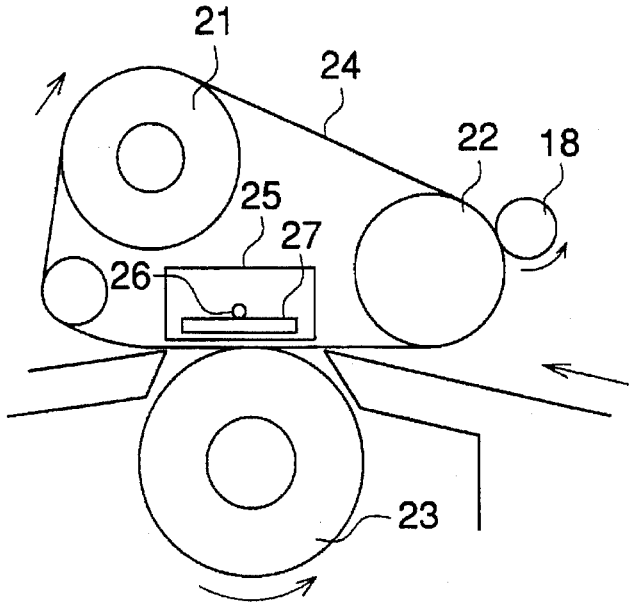
FIG. 2 is a drawing showing a schematic diagram example of a heat fixing method which causes to contact a heating material and a recording material through a film member of another example of the present invention.
Figure 3:
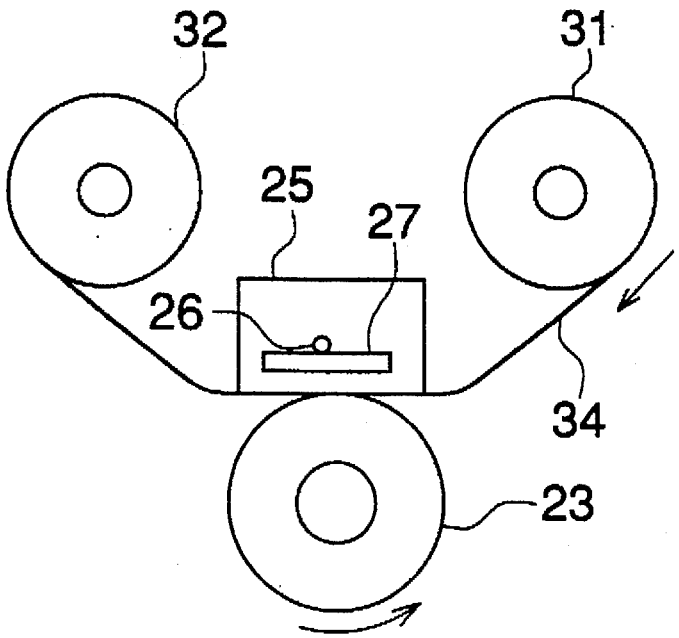
FIG. 3 is a drawing showing a schematic diagram example showing a varied example of the heat fixing method shown in Fig.

Namely, as shown in FIG. 2, double-ending film member 34 is wound onto sheet feeding shaft 31 and winding shaft 32. Following fixing, film member 34 is caused to be gradually shifted in the arrowed direction. In this occasion, the above-mentioned band-shaped film member is driven by winding shaft 32. Numerals 23, 25, 26 and 27 are identical to those in FIG. 2.

Double-ending film member 34, which is wound to sheet feeding shaft 21 by winding shaft 32, is wound up gradually, following fixing. Between double-ending film member 34 and pressure roller 23, a recording member, which carries the toner image is passed. Thus, toner images are fused-fixed on a recording member by passing through low heat-capacity bar-shaped heating material 25.

In either case, a fixing cleaning mechanism may be provided if necessary. In such an occasion, a method wherein silicone oil is supplied to the fixing upper roller or a film and a cleaning method using a pad, roller or a web wherein a silicone oil is impregnated can be used. As a silocone oil, those having high heat durability such as polydimethyl silicone and polyphenyl methylsilicone can be used. Since those having low viscosity overflow excessively when using, those having 1000–100000 cp viscosity at 20° C. are preferably used.

EXAMPLE

Hereunder, the present invention will be explained in detail referring to examples. However, the embodiment of the present invention is not limited thereto.

(Preparation of Resin)

Resin Preparation Example 1

A monomer mixture composed of a styrene monomer, a butylacrylate monomer and an acrylic acid monomer was subjected to suspension polymerization to obtain a high molecular weight component (HP) having Mw of 650,000. Next, in the presence of this HP, a styrene monomer was subjected to solution polymerization to obtain Resin 1. In this occasion, $$Mw_L=4{,}000,\ |Tg_L-Tg_H|=3°\ C.,\ St_L/St_H=1.1 \text{ and } W_L=70\ (\%).$$

Incidentally, $Tg_L$ represents Tg of a resin polymerized without adding HP.

Resin Preparation Example 2

A monomer mixture composed of a styrene monomer, a butylacrylate monomer and an acrylic acid monomer was subjected to suspension polymerization to obtain a high molecular weight component (HP) having Mw of 670,000. Next, in the presence of this HP, a monomer mixture composed of a styrene monomer and a butylacrylate monomer was subjected to solution polymerization to obtain Resin 2. In this occasion, $$Mw_L=6{,}000,\ |Tg_L=Tg_H|=6°\ C.,\ St_L/St_H=1.2 \text{ and } W_l=72\ (\%).$$

Resin Preparation Example 3

A monomer mixture composed of a styrene monomer, a butylacrylate monomer and an acrylic acid monomer was subjected to suspension polymerization to obtain a high molecular weight component (HP) having Mw of 630,000. Next, in the presence of this HP, a monomer mixture composed of a styrene monomer, a butylacrylate monomer and an acrylic acid monomer was subjected to solution polymerization to obtain Resin 3. In this occasion, $$Mw_L=4{,}000,\ |Tg_L=Tg_H|=4°\ C.,\ St_L/St_H=1.3 \text{ and } W_L=65\ (\%).$$

Resin Preparation Example 4

A monomer mixture composed of a styrene monomer, and a butylacrylate monomer was subjected to suspension polymerization to obtain a high molecular weight component (HP) having Mw of 620,000. Next, in the presence of this HP, a monomer mixture composed of a styrene monomer, a butylacrylate monomer and an acrylic acid monomer was subjected to solution polymerization to obtain Resin 4. In this occasion, $$Mw_L=6{,}000,\ |Tg_L=Tg_H|=10°\ C.,\ St_L/St_H=1.00 \text{ and } W_L=70\ (\%).$$

Resin Preparation Examples 5 and 6

In the same manner as in Resin Preparation Example 4, Resins 5 and 6 were prepared. Table 1 shows $Mw_L$, $Mw_H$, $|Tg_L-Tg_{H|}$, $_{stL}/St_H$, and $W_L$.

Resin Preparation Example 7

A monomer mixture composed of a styrene monomer and a butylacrylate monomer was subjected to suspension polymerization to obtain a high molecular weight component (HP) having Mw of 4,000,000. Next, in the presence of this HP, a monomer mixture composed of a styrene monomer and a butylacrylate monomer was subjected to emulsification polymerization to obtain Resin 7. In this instance, $Mw_L$=10,000, $|Tg_L-Tg_H|$=11° C., $St_L/St_H$=1.4 and $W_L$=84 (%).

TABLE 1

| | | List of Resin Preparation Examples | | | | | |
|---|---|---|---|---|---|---|---|
| | | MWL ($\times 10^4$) | MWH ($\times 10^4$) | \|TgL-TgW\| (°C.) | StL/StH | WL (wt %) | Tg |
| Resin Preparation Example 1 | Resin 1 | 0.4 | 65 | 3 | 1.1 | 70 | 55 |
| Resin Preparation Example 2 | Resin 2 | 0.6 | 67 | 6 | 1.2 | 72 | 56 |
| Resin Preparation Example 3 | Resin 3 | 0.4 | 63 | 4 | 1.3 | 65 | 56 |
| Resin Preparation Example 4 | Resin 4 | 0.6 | 62 | 10 | 1.0 | 70 | 54 |
| Resin Preparation Example 5 | Resin 5 | 0.8 | 62 | 5 | 0.9 | 74 | 52 |
| Resin Preparation Example 6 | Resin 6 | 1.3 | 55 | 4 | 0.9 | 65 | 56 |
| Resin Preparation Example 7 | Resin 7 | 1.0 | 400 | 11 | 1.4 | 84 | 54 |

Comparative Resin Preparation Example 1

A styrene monomer, a metylacrylate monomer and a butylacrylate were subjected to suspension polymerization to obtain a high molecular weight component (HP) having Mw of 650,000. Next, in the presence of this HP, a styrene monomer, a butylacrylate monomer and an acrylic acid monomer were subjected to solution polymerization to obtain Comparative Resin 1. In this occasion, $Mw_L$=6,000, $|Tg_L-Tg_H|$=13° C., $St_L/St_H$=1.2 and $W_L$=80 (%).

Comparative Resin Preparation Example 2

A styrene monomer and a butylacrylate were subjected to suspension polymerization to obtain a high molecular weight component (HP) having Mw of 650,000. Next, in the presence of this HP, a styrene monomer, a styrene monomer and a butylacrylate monomer were subjected to solution polymerization to obtain Comparative Resin 2. In this instance, $MW_L$=6,000, $|Tg_L-Tg_H|$=12° C., $St_L/St_H$=1.2 and $W_L$=72 (%).

Comparative Resin Preparation Example 3

A styrene monomer, a methyl methacrylate monomer and a butylacrylate monomer were subjected to suspension polymerization to obtain a high molecular weight component (HP) having Mw 650,000. Next, in the presence of this HP, a styrene monomer and a 2-ethylhexylacrylate monomer were subjected to solution polymerization to obtain Comparative Resin 3. In this instance, $Mw_L$=4,000, $|Tg_L-Tg_H|$=10° C., $St_L/St_H$=1.2 and $W_L$=65 (%).

Comparative Resin Preparation Examples 4

In the same manner as in Comparative Resin Preparation Example 1, Comparative Resin 4 was prepared. Table 2 shows $Mw_L$, $Mw_H$, $|Tg_L-Tg_H|$, $St_L/St_H$, and $W_L$.

TABLE 2

| | | List of Comparative Resin Examples | | | | | |
|---|---|---|---|---|---|---|---|
| | | MWL ($\times 10^4$) | MWH ($\times 10^4$) | \|TGL-TGH\| (°C.) | StL/StH | WL (wt %) | Tg |
| Comparative Resin Preparation Example 1 | Comparative Resin 1 | 0.6 | 65 | 13 | 1.2 | 80 | 48 |
| Comparative Resin Preparation Example 2 | Comparative Resin 2 | 0.6 | 65 | 12 | 1.2 | 72 | 66 |

TABLE 2-continued

| | | List of Comparative Resin Examples | | | | | |
|---|---|---|---|---|---|---|---|
| | | MWL ($\times 10^4$) | MWH ($\times 10^4$) | \|TGL-TGH\| (°C.) | StL/StH | WL (wt %) | Tg |
| Comparative Resin Preparation Example 3 | Comparative Resin 3 | 0.4 | 65 | 10 | 1.2 | 65 | 46 |
| Comparative Resin Preparation Example 4 | Comparative Resin 4 | 0.4 | 72 | 6 | 1.0 | 50 | 62 |
| Comparative Resin Preparation Example 5 | Comparative Resin 5 | 1.2 | 65 | 2 | 1.3 | 90 | 58 |
| Comparative Resin Preparation Example 6 | Comparative Resin 6 | 1.0 | 400 | 13 | 1.1 | 95 | 53 |
| Comparative Resin Preparation Example 7 | Comparative Resin 7 | 0.8 | 62 | 5 | 1.2 | 55 | 52 |

Comparative Resin Preparation Examples 5

In the same manner as in Comparative Resin Preparation Example 2, Comparative Resin 5 was prepared. Table 2 shows $Mw_L$, $Mw_H$, $|Tg_L-Tg_H|$, $St_L/St_H$, and $W_L$.

Comparative Resin Preparation Example 6

A monomer mixture composed of a styrene monomer and a butylacrylate were subjected to suspension polymerization to obtain a high molecular weight component (HP) having Mw of 4,000,000. Next, in the presence of this HP, a styrene monomer and butylacrylate monomer were subjected to solution polymerization to obtain Comparative Resin 7. In this instance, $$MW_L=10{,}000,\ |Tg_L-Tg_H|=13°\ C.,\ St_L/St_H=1.1 \text{ and } W_L=95\ (\%).$$

Comparative Resin Preparation Examples 7

In the same manner as in Comparative Resin Preparation Example 2, Comparative Resin 7 was prepared. Table 2 shows $Mw_L$, $Mw_H$, $|Tg_L-Tg_H|$, $St_L/St_H$, and $W_L$.

(Preparation of Toner)

Toner Preparation Example 1

In a V-shaped mixer, 100 parts by weight of resin 1, 10 parts by weight of carbon black and 4 parts by weight of low-molecular-weight polypropylene wax were subjected to dry blending. The resulting mixture was subjected to heat molten kneading in a two-axial kneading machine. The resulting kneaded material was crushed and classified to obtain toner component 1 having a volume average particle size of 9 μm. In a tabular, 100 parts by weight of the above-mentioned toner component 1 and 1.0 parts by weight of silica processed with hydrophobicity providing processing, were subjected to dry blending so as to obtain a toner.

Toner Preparation Examples 2–7

In the same manner as in Toner Preparation Example 1, Toner 2–7 were obtained.

Comparative Toner Preparation Examples 1–7

In the same manner as in Toner Preparation Example 1, Comparative Toner 1–7 were obtained.

Table 3 shows physical values of Toner Components 1–7 and Comparative Toner Components 1–5.

TABLE 3

| List of the Physical values of Toner components | | | | |
|---|---|---|---|---|
| | Tg (°C.) | TFS (°C.) | (⅓) × (log$\eta_{121}$'– log$\eta_{118}$') | (⅓) × (log ($G_{200}$')– log ($G_{197}$')) |
| Toner 1 | 55 | 52 | −0.053 | −0.011 |
| Toner 2 | 56 | 55 | −0.045 | −0.013 |
| Toner 3 | 56 | 54 | −0.042 | −0.011 |
| Toner 4 | 54 | 52 | −0.039 | −0.013 |
| Toner 5 | 52 | 50 | −0.058 | −0.012 |
| Toner 6 | 56 | 58 | −0.038 | 0.002 |
| Toner 7 | 54 | 46 | −0.054 | −0.023 |
| Comparative Toner 1 | 48 | 43 | −0.058 | −0.032 |
| Comparative Toner 2 | 66 | 66 | −0.041 | −0.000 |
| Comparative Toner 3 | 46 | 43 | −0.050 | −0.002 |
| Comparative Toner 4 | 62 | 68 | −0.032 | −0.001 |
| Comparative Toner 5 | 58 | 55 | −0.062 | −0.030 |
| Comparative Toner 6 | 53 | 45 | −0.069 | −0.031 |
| Comparative Toner 7 | 52 | 46 | −0.033 | −0.001 |

TFS: Falling starting temperature

In the present invention, a glass transition point of a toner is the same as a binder resin of the toner.

(Toner Evaluation)

6 parts by weight of toners 1–7 and Comparative Toners 1–7 and 100 parts by weight of fluorine-containing carrier having volume average particle size of 65 λm were respectively mixed to be used for actual copying evaluation.

The resulting mixtures were subjected to the following evaluation. The obtained results are shown in Table 4.

(1) Fixing property at high speed and low temperature

Images were formed while temperature set to the fixing machine was changed from 120° C. to 180° C. The images were scrubbed using a bleached cotton cloth. The change of reflective density before and after scrubbing was defined to be the fixing ratio. The fixing ratio was calculated as the reflective density after scrubbing/reflective density before scrubbing. Temperature at which the fixing ratio was 70% or more was defined to be the minimum fixing temperature.

Condition (1)

As a heat roller fixing method, a copying machine 3035 produced by Konica Corporation was modified and employed.

As a heat roller fixing device, one wherein there was a upper roller of 40 mm diameter, whose surface was covered with a tetrafluoroethylene-perfluoroalkyl vinyl ether copolymer, composed of cylindrical iron, integrally housing a heater in its interior central portion and there was also a lower 40 mm diameter roller constituted of silicone scrubber whose surface was coated with a tetrafluoroethylene-perfluoroalkylether copolymer. Line pressure was set at 1.0 kg/cm, and nip width was 5.0 mm. By the use of the above-mentioned fixing device, the printing line speed was set at 230 mm/sec. Incidentally, as a cleaning mechanism for the fixing device was not provided.

Condition (2)

As a film-shaped fixing method, a heat roll fixing device in a copying machine 1112 produced by Konica Corporation was modified to be used. As a film-shaped fixing device, an endless sheet fixing device was used as shown in FIG. 2. The fixing conditions were set as follows.

Fixing conditions:

Total pressure between the heating material 15 and the pressure roller 13=15 kg Nip width between the pressuring roller and the film material=3 mm The film material: a polyimide film, covered with polytetrafluoroethylene wherein conductive material was dispersed on its surface, whose thickness was 15 λm, Line speed=60 m/sec.

(2) Anti-offset performance

The temperature was fixed to a prescribed one and an original was continuously copied for 100 sheets. After that, whether there occurred offset was visually evaluated. When no offset was observed, it was ranked as "A". When the occurrence of the offset was observed, it was ranked as "B". When offset was remarkably obserbed, it was ranked as "C".

As a heat roll fixing method, a copying machine Konica U-BIX 3035 produced by Konica Corporation was modified to be used. The fixing temperature was 200° C.

As a film-shaped fixing method, the heat roll fixing device of a copying machine Konica U-BIX 1112 produced by Konica Corporation was modified to a film-shaped fixing device to be used. The fixing temperature was 160° C.

The conditions of each fixing device, i.e., the heat roll fixing device and the film-shaped fixing device, was identical as above.

(3) Anti-Smearing performance

Using a copying machine Konica U-BIX 3035 produced by Konica Corporation, both surfaces of the original were copied. After that, whether there is roller contamination by a conveyance roller and whether there is image contamination due to scrubbing by each paper were visually evaluated. When no smearing was observed, it was evaluated as rank "A". When the occurrence of smearing was observed, it was evaluated as rank "B". When the degree of the occurrence of smearing is serious, it was evaluated as rank "C".

(4) Storage performance

In a sample tube, 1 g of toner was sampled. The toner was subjected to tapping for 500 times, and then, left for 2 hours at 55° C. and 26% RH. Next, the toner was sieved for 10 seconds with Mesh 48. The weight of remaining toner was divided by the total toner weight. Its percentage was evaluated as a coagulation ratio. When the coagulation ratio exceeds 50%, it is not suitable for practical use.

TABLE 4

| | List of Toner Performance | | | | |
|---|---|---|---|---|---|
| | Fixing Performance at High Speed | | | Storage Performance | Anti- |
| Sample No. | Condition (1) | Condition (2) | Anti-offset Performance | (Coagulation Ratio) (%) | Smearing Performance |
| Toner 1 | 145° C. | 140° C. | A | 33 | A |
| Toner 2 | 150 | 150 | A | 20 | A |
| Toner 3 | 150 | 145 | A | 14 | A |
| Toner 4 | 155 | 150 | A | 12 | A |
| Toner 5 | 145 | 145 | A | 29 | A |
| Toner 6 | 160 | 160 | A | 9 | A |
| Toner 7 | 140 | 130 | A | 35 | A |
| Comparative Toner 1 | 135 | 125 | C | 86 | C |
| Comparative Toner 2 | 180 | Not fixed | A | 4 | A |
| Comparative Toner 3 | 145 | 140 | C | 78 | B |
| Comparative Toner 4 | 190 | Not fixed | A | 10 | A |
| Comparative Toner 5 | 140 | 135 | C | 25 | C |

TABLE 4-continued

| | List of Toner Performance | | | | |
|---|---|---|---|---|---|
| | Fixing Performance at High Speed | | | Storage Performance | Anti- |
| Sample No. | Condition (1) | Condition (2) | Anti-offset Performance | (Coagulation Ratio) (%) | Smearing Performance |
| Comparative Toner 6 | 135 | 125 | C | 57 | C |
| Comparative Toner 7 | 165 | 160 | A | 62 | A |

As is apparent from the above-mentioned examples, toner 1–7 of the present invention attained in practical level in terms of the minimum fixing temperature, offset property, coagulation ratio and anti-Smearing performance. On the contrary, it can be understood that comparative toner 1–7 without the scope of the present invention had problems in terms of any of the above-mentioned factors.

What is claimed is:

1. A toner for developing an electrostatic latent image, comprising a binder resin, a colorant and a releasing agent, wherein said toner has:

(1) a storage modulus (G') having a falling starting temperature of 45° to 65° C., when a visco-modulus of said toner is measured by a rheometer, (2) a first inclination represented by $(1/3)\times(\log(\eta'_{121})-\log(\eta'_{118}))$ is −0.065 to −0.035 at 120° C., wherein said $\log(\eta'_{121})$ represents a common logarithm of a fusion viscosity (η) of said toner at 121° C., said $\log(\eta'_{118})$ represents a common logarithm of a fusion viscosity (η) of said toner at 118° C., and said first inclination represented by $(1/3)\times(\log(\eta'_{121})-\log(\eta'_{118}))$ represents an inclination of a tangent at 120° C., when said logarithm of said fusion viscosity (η) is plotted as a function of degree of Celsius, and (3) a second inclination represented by $(1/3)\times(\log(G'_{200})-\log(G'_{197}))$ is not less than −0.025 at 200° C., wherein said $\log(G'_{200})$ represents a common logarithm of said storage modulus (G') at 200° C., said $\log(G'_{197})$ represents a common logarithm of said storage modulus (G') at 197° C., and said second inclination represented by $(1/3)\times(\log(G'_{200})-\log(G'_{197}))$ represents an inclination of a tangent at 200° C., when said logarithm of said storage modulus (G') is plotted as a function of degree of Celsius.

2. The toner of claim 1, wherein said binder resin comprises a resin selected from the group consisting of polyester resins and vinyl resins.

3. The toner of claim 1, wherein said binder resin comprises a vinyl resin having a monomer unit selected from the group consisting of an aromatic vinyl monomer unit and an α-methylene aliphatic carboxylic ester monomer unit.

4. The toner of claim 1, wherein said binder resin comprises a vinyl resin having a low-molecular weight component and a high-molecular weight component, wherein said low-molecular weight component has a maximum value of not more than 30,000 in a molecular weight distribution measured by gel permeation chromatography, and said high-molecular weight component has a maximum value of not more than 70,000 in a molecular weight distribution measured by gel permeation chromatography.

5. The toner of claim 1, wherein said binder resin is a vinyl resin having a low-molecular weight component and a high-molecular weight component, wherein said low-molecular weight component has a weight average molecular weight ($Mw_L$) of 2,000 to 15,000 measured by gel permeation chromatography, and said high-molecular weight component has a weight average molecular weight ($Mw_H$) of $3\times10^5$ to $5\times10^6$ measured by gel permeation chromatography.

6. The toner of claim 5, wherein said vinyl resin has a glass transition point (Tg) of 45° to 65° C., said low-molecular weight component is contained in an amount ($W_L$) of 60 to 90% by weight of said resin, and said glass transition point (Tg), said amount ($W_L$), said weight average molecular weight ($Mw_L$) satisfy the following equations 1, 2 and 3:

$$300\times W_L-2000\times Tg+80{,}000<Mw_L<300\times W_L-2000\times Tg+111{,}000, \quad \text{Equation 1}$$

$$\text{Log}(Mw_H)-0.08\times W_L+0.4>0, \quad \text{Equation 2}$$

$$800\times W_L-64{,}000<Mw_L<800\times W_L-38{,}000. \quad \text{Equation 3.}$$

7. The toner of claim 1, wherein said binder resin is a vinyl resin having a low-molecular weight component and a high-molecular weight component, wherein a first glass transition point ($Tg_L$) of said low-molecular-weight component and a second glass transition point ($Tg_H$) of said high-molecular-weight component satisfy the following equation 4:

$$|Tg_L-Tg_H|\leqq 20\ (°\ C.). \quad \text{Equation 4.}$$

8. The toner of claim 1, wherein said binder resin comprises a vinyl resin having a low-molecular weight component and a high-molecular weight component, wherein said low-molecular weight component and said high-molecular weight component contain a monomer unit selected from the group consisting of an aromatic vinyl monomer unit and an α-methylene aliphatic carboxylic ester monomer unit.

9. The toner of claim 8, wherein a first aromatic vinyl monomer content ratio ($St_L$) of said low-molecular weight component and a second aromatic vinyl monomer content ratio ($St_H$) of said high-molecular weight component satisfy the following equation 2:

$$0.5\leqq St_L/St_H\leqq 2.0. \quad \text{Equation 2.}$$

10. The toner of claim 3, wherein an aromatic vinyl monomer of said aromatic vinyl monomer unit is a monomer selected from the group consisting of styrene, o-methylstyrene, m-methylstyrene, p-methylstyrene, p-ethylstyrene, 2,3-dimethylstyrene, 2,4-dimethylstyrene, p-n-butylstyrene, p-terbutylstyrene, p-n-hexylstyrene, p-n-octylstyrene, p-n-nonylstyrene, p-n-decylstyrene, p-n-dodecylstyrene, p-methoxystyrene, p-chlorostyrene and 3,4-dichlorostyrene.

11. The toner of claim 3, wherein a α-methylene aliphatic carboxylic ester monomer of said α-methylene aliphatic carboxylic ester monomer unit is a monomer selected from the group consisting of methyl acrylate, ethyl acrylate, propyl acrylate, n-butyl acrylate, isobutyl acrylate, n-octyl acrylate, dodecyl acrylate, 2-ethylhexyl acrylate, stearyl acrylate, methyl methacrylate, ethyl methacrylate, propyl methacrylate, n-butyl methacrylate, isobutyl methacrylate, n-octyl methacrylate, dodecyl methacrylate, 2-ethylhexyl methacrylate and stearyl methacrylate.

12. A toner for developing an electrostatic latent image, comprising a binder resin, a colorant and a releasing agent, wherein said toner has:

(1) a storage modulus (G') having a falling starting temperature of 45° to 65° C., when a visco-modulus of said toner is measured by a rheometer, (2) a first inclination represented by $(1/3)\times(\log(\eta'_{121})-\log(\eta'_{118}))$ is −0.065 to −0.035 at 120° C., wherein said $\log(\eta'_{121})$ represents a common logarithm of a fusion viscosity (η) of said toner at 121° C., said $\log(\eta'_{118})$ represents a common logarithm of a fusion viscosity (η ) of said toner at 118° C., and said first inclination represented by $(1/3)\times(\log(\eta'_{121})-\log(\eta'_{118}))$ represents an inclination of a tangent at 120° C., when said logarithm of said fusion viscosity (η) is plotted as a function of degree of Celsius, and (3) a second inclination represented by $(1/3)\times(\log(G'_{200})-\log(G'_{197}))$ is not less than −0.025 at 200° C., wherein said $\log(G'_{200})$ represents a common logarithm of said storage modulus (G') at 200° C., said $\log(G'_{197})$ represents a common logarithm of said storage modulus (G') at 197° C., and said second inclination represented by $(1/3)\times(\log(G'_{200})-\log(G'_{197}))$ represents an inclination of a tangent at 200° C., when said logarithm of said storage modulus (G') is plotted as a function of degree of Celsius, and, wherein said binder resin comprises a vinyl resin, wherein said vinyl resin has:

a monomer unit selected from the group consisting of an aromatic vinyl monomer unit and an α-methylene aliphatic carboxylic ester monomer unit, and a low-molecular weight component and a high-molecular weight component, wherein said low-molecular weight component has a maximum value of not more than 30,000 in a molecular weight distribution measured by gel permeation chromatography, and said high-molecular weight component has a maximum value of not more than 70,000 in a molecular weight distribution measured by gel permeation chromatography.

* * * * *